US011142804B2

(12) United States Patent
Thaler et al.

(10) Patent No.: US 11,142,804 B2
(45) Date of Patent: Oct. 12, 2021

(54) TOP COMBUSTION STOVE

(71) Applicants: PAUL WURTH REFRACTORY & ENGINEERING GMBH, Mainz-Kastel (DE); PAUL WURTH S.A., Luxembourg (LU)

(72) Inventors: Stefan Thaler, Flörsheim (DE); Stefan Kessler, Dorsheim (DE); Eric Schaub, Limburg (DE); Hossein Sa'Doddin, Mainz-Kastel (DE); Jurij Luft, Bad Kreuznach (DE)

(73) Assignee: PAUL WURTH DEUTSCHLAND GMBH, Wiesbaden (DE)

( * ) Notice: Subject to any disclaimer, the term of this patent is extended or adjusted under 35 U.S.C. 154(b) by 134 days.

(21) Appl. No.: 15/776,527

(22) PCT Filed: Nov. 28, 2016

(86) PCT No.: PCT/EP2016/078926
§ 371 (c)(1),
(2) Date: May 16, 2018

(87) PCT Pub. No.: WO2017/093152
PCT Pub. Date: Jun. 8, 2017

(65) Prior Publication Data

US 2018/0340237 A1 Nov. 29, 2018

(30) Foreign Application Priority Data

Nov. 30, 2015 (EP) ..... 15197118

(51) Int. Cl.
*C21B 9/04* (2006.01)
*F23C 3/00* (2006.01)
(Continued)

(52) U.S. Cl.
CPC ..... *C21B 9/04* (2013.01); *C21B 9/02* (2013.01); *C21B 9/10* (2013.01); *C21B 9/14* (2013.01);
(Continued)

(58) Field of Classification Search
CPC .... C21B 9/04; C21B 9/02; C21B 9/10; C21B 9/14; C21B 9/00; F23C 5/32; F23C 3/006;
(Continued)

(56) References Cited

U.S. PATENT DOCUMENTS 1,591,679 A * 7/1926 Hawley ..... F23C 3/008 110/347
3,173,666 A * 3/1965 Petit ..... F28D 17/00 432/214
(Continued)

FOREIGN PATENT DOCUMENTS

CN 1198944 C 4/2005
CN 1680608 A 10/2005
(Continued)

OTHER PUBLICATIONS

CN Office Action dated Feb. 11, 2019 re: Application No. 201680070083.9, pp. 1-16, citing: CN204080004U, CN201634702U, CN1198944C, U.S. Pat. No. 4,054,409A and CN202018034U.
(Continued)

*Primary Examiner* — Kenneth J Hansen
*Assistant Examiner* — Dana K Tighe
(74) *Attorney, Agent, or Firm* — Cantor Colburn LLP

(57) ABSTRACT

A burner assembly for top combustion hot blast stove including a burner surrounded by a burner shell, where the burner has a circular cross-section; a number of air nozzles arranged for tangentially feeding air to the burner, the air nozzles being connected to one or more air distribution
(Continued)

chambers; a number of gas nozzles arranged for tangentially feeding gas to the burner, the gas nozzles being connected to one or more gas distribution chambers; wherein the air nozzles are arranged in one or more inclined or vertical stacked arrays of air nozzles, each inclined or vertical stacked array being in connection with one inclined or vertical air distribution chamber; the gas nozzles are arranged in one or more inclined or vertical stacked arrays of gas nozzles, each inclined or vertical stacked array being in connection with one inclined or vertical gas distribution chamber; and the inclined or vertical air distribution chamber(s) and the inclined or vertical gas distribution chamber (s) are arranged along the circumference of the burner shell.

14 Claims, 2 Drawing Sheets

(51) Int. Cl.

| | |
|---|---|
| ***F23C 5/32*** | (2006.01) |
| ***F23D 14/22*** | (2006.01) |
| ***C21B 9/10*** | (2006.01) |
| ***C21B 9/14*** | (2006.01) |
| ***C21B 9/02*** | (2006.01) |

(52) U.S. Cl.
CPC ..... *F23C 3/006* (2013.01); *F23C 5/32* (2013.01); *F23D 14/22* (2013.01)

(58) Field of Classification Search
CPC ..... F23C 3/008; F23C 7/002; F23C 7/004; F23C 7/006; F23D 14/22
USPC ..... 432/217
See application file for complete search history.

(56) References Cited

U.S. PATENT DOCUMENTS

| | | | | |
|---|---|---|---|---|
| 4,054,409 | A | 10/1977 | Ando et al. | |
| 4,614,496 | A * | 9/1986 | Binglin | C21B 9/00 432/214 |
| 4,997,362 | A * | 3/1991 | Hebei | C21B 9/00 431/170 |
| 5,014,631 | A * | 5/1991 | Ikeda | F23C 3/008 110/264 |
| 2009/0126715 | A1 * | 5/2009 | Grassi | F24C 3/126 126/39 R |
| 2010/0323314 | A1 | 12/2010 | Kalugin | |

FOREIGN PATENT DOCUMENTS

| | | | | |
|---|---|---|---|---|
| CN | 201288198 | Y | 8/2009 | |
| CN | 201634702 | U | 11/2010 | |
| CN | 201819218 | U | 5/2011 | |
| CN | 202018034 | U | 10/2011 | |
| CN | 204080004 | U | 1/2015 | |
| EP | 2177633 | A1 | 4/2010 | |
| JP | S51133108 | A | 11/1976 | |
| JP | 2009052123 | A | 3/2009 | |
| JP | 2010533241 | A | 10/2010 | |
| RU | 2194768 | C1 * | 12/2002 | C21B 9/00 |
| WO | 0058526 | A1 | 10/2000 | |
| WO | 2015094011 | A1 | 6/2015 | |

OTHER PUBLICATIONS

International Search Report dated Jan. 25, 2017 re: Application No. PCT/EP2016/078926, pp. 1-3, citing: US 2010/323314 A, CN 201 288 198 Y and U.S. Pat. No. 4,054,409 A.

Written Opinion dated Jan. 25, 2017 re: Application No. PCT/EP2016/078926, pp. 1-6, citing: US 2010/323314 A, CN 201 288 198 Y and U.S. Pat. No. 4,054,409 A.

JP Office Action dated Oct. 27, 2020 re: Application No. P2018/527947, pp. 1-3, citing: CN1680608A, CN201288198Y, JP2010-533241 A, EP2177633A1, JPS51-133108A and U.S. Pat. No. 4,054,409A.

JP Office Action dated May 18, 2021 re: Application No. P2018-527947, pp. 1-5, citing: CN1680608A, CN201819218U, and JP2009052123A.

* cited by examiner

TOP COMBUSTION STOVE

TECHNICAL FIELD

The present disclosure generally relates to burner assemblies for hot blast stoves (regenerative air heating devices) for preheating blast in blast furnace operation. More particularly, the disclosure relates to so-called top or dome combustion stoves wherein the burner is arranged on top of the stove.

BACKGROUND ART

It is well known within the art of regenerative heating, especially in the art of hot blast stoves, to heat air by passing it through previously heated refractories, generally called checker bricks. The heating of the checker bricks is done by burning top gas from a blast furnace usually enriched with natural gas or coke oven gas in the presence of air, the resulting flue gases being passed through the checker bricks.

The burning of the combustion media (gas and air) is conventionally done in a separate shaft (burner shaft) within the hot blast stove or more recently in the top dome of so-called top or dome combustion hot blast stoves.

Known top combustion hot blast stoves generally comprise a burner arranged on top of the hot blast stove fed with gas and air either separately or premixed through nozzles to the combustion chamber. These known configurations have a cylindrical combustion chamber with a ring distribution of the combustion media. In such configurations, each medium (air and gas) has its own circular conduct system with associated nozzles generally integrated within the shell of the burner. Typical examples of this type are described in WO 00/58526, U.S. Pat. No. 4,054,409, CN 201 288 198 Y or WO 2015/094011. A major drawback of these systems is that the structure of the shell is rendered fragile by the existence of the circumferential conducts. Furthermore these configurations require a huge number of differently shaped bricks and hence significant assembly work.

BRIEF SUMMARY

The disclosure provides a burner configuration for top combustion hot blast stoves which allow overcoming at least some of said known disadvantages, preferably by providing good or even better combustion performance.

In order to overcome at least some of the above-mentioned problem, the present disclosure proposes, in a first aspect, a burner assembly for top combustion hot blast stove comprising a burner surrounded by a burner shell, wherein said burner has a circular cross-section; a number of air nozzles arranged (within the burner shell) for tangentially feeding air to the burner, the air nozzles being connected to one or more (separate) air distribution chambers; a number of gas nozzles arranged (within the burner shell) for tangentially feeding gas to the burner, the gas nozzles being connected to one or more (separate) gas distribution chambers. Contrary to known solutions, the air nozzles are arranged in one or more inclined or vertical stacked arrays of air nozzles, each inclined or vertical stacked array being in connection with one inclined or vertical air distribution chamber; the gas nozzles are arranged in one or more inclined or vertical stacked arrays of gas nozzles, each inclined or vertical stacked array being in connection with one inclined or vertical gas distribution chamber; and the air distribution chamber(s) and the gas distribution chamber(s) are arranged (i.e. distributed) along the circumference of the burner shell.

In a second aspect, the disclosure relates to a top combustion hot blast stove comprising a stove shell; a volume of checker bricks arranged within said stove shell; a burner surrounded by a burner shell, wherein said burner has a circular cross-section and is axially arranged in an upper section of the stove shell; a number of air nozzles arranged for tangentially feeding air to the burner, the air nozzles being connected to one or more (separate) air distribution chambers; and a number of gas nozzles arranged for tangentially feeding gas to the burner, the gas nozzles being connected to one or more (separate) gas distribution chambers. Again, contrary to known solutions, the air nozzles are arranged in one or more inclined or vertical stacked arrays of air nozzles, each inclined or vertical stacked array being in connection with one inclined or vertical air distribution chamber; the gas nozzles are arranged in one or more inclined or vertical stacked arrays of gas nozzles, each inclined or vertical stacked array being in connection with one inclined or vertical gas distribution chamber; and the air distribution chamber(s) and the gas distribution chamber(s) are arranged (i.e. distributed) along the circumference of the burner shell.

The burner surrounded by the burner shell thus defines an essentially cylindrical inner (and generally also outer) volume closed on top by a dome shaped cover and open on its bottom side, said bottom side being configured for attachment to a hot blast stove as further described herein.

The air and gas distribution chambers may be arranged within the burner shell or they may be attached to the exterior of said shell. In a preferred variant, the air and gas distribution chambers are arranged within the walls of the burner shell, preferably, but not necessarily in a centered position with respect to the thickness of the burner shell. In cases where more than one of each air and gas distribution chambers are arranged along the circumference of the burner shell, they will generally be arranged alternatingly (air-gas-air-gas . . . ), although other arrangements, such two-by-two (air-air-gas-gas . . . ) etc. are also considered within the scope of the disclosure. While it seems clear that any two separate distribution chambers fed with a different medium (air or gas) are never interconnected (air and gas are only brought together within the burner's primary combustion chamber), any two inclined or vertical distribution chambers conveying the same medium are also never interconnected within the burner shell. In other words, if there are two or more inclined or vertical distribution chambers conveying the same medium, these are separate and do not have any fluidic connection between them within the burner shell. Hence, in case the burner assembly of the disclosure comprises two or more inclined or vertical air distribution chambers and two or more inclined or vertical gas distribution chambers, none of said two or more inclined or vertical air distribution chambers have a fluidic interconnection within the burner shell and none of said two or more inclined or vertical gas distribution chambers have a fluidic interconnection within the burner shell.

The particular combination of the inclined or even essentially vertically stacked nozzles and tangential gas and air inlet along the circumference of the burner allows for a swirl flow with improved layering and burn off of the combustion media. More importantly, this advantageous combustion conditions are achieved while the structural stability of the burner is drastically increased even if the distribution chambers are arranged within the burner shell compared to known solutions with circumferential horizontal distribution chambers. Indeed, the distribution chambers being inclined or vertical and arranged or distributed along the circumference of the burner, the burner shell comprises continuous inclined or vertical bottom to top wall sections in-between the discrete number of distribution chambers. Furthermore, the wall structure of the burner shell is significantly simplified in terms of brick shapes and assembly work necessary for its construction. As the burner assembly according to the present disclosure does not comprise annular or coaxial distribution chambers, or any other type of interconnection between distribution chambers within the burner shell, the weak inner ring bricks of such known solutions are avoided by the present configuration. A burner as described herein does therefore not require further constructional measures to ensure its structural stability. The height of said air and gas distribution chambers generally represents about 0.3 to about 1, preferably about 0.5 to about 0.9, more preferably about 0.6 to about 0.8 times the height of the burner's cylindrical inner volume, also called combustion chamber or more particularly primary combustion chamber. Depending on the size and intended capacity of the burner, the number of distribution chambers per combustion media will generally be between 1 and 10, preferably between 2 and 4, although this number may exceed 10 if necessary or desired.

In general, the distribution chambers will be inclined or vertical shaft sections, preferably with a round or polygonal cross-section, having a number of vertically (and laterally if inclined) spaced apertures to the burner, said apertures being the nozzles for feeding the combustion media to the burner. In cases of essentially vertical distribution chambers, they will generally be essentially straight shafts. In cases where the distribution chambers are inclined, they may have a curved shape, wherein the curve essentially follows (or corresponds to) the circular shape of the burner shell. Depending on the angle of inclination and on the length of the shaft (i.e. the height of the burner), the distribution chambers will each have the shape of a (section of a) spiral or helix. Depending on the configuration (number of air and gas distribution chambers, angle of inclination and height of the burner), the distribution chambers may represent a number of intertwined helices. The circumferential angle of such an inclined (helix-shaped) distribution chamber within the burner shell may represent up to 90° or even more if desired. In any case, however, the stability of the burner shell will be safeguarded by continuous (inclined or vertical) wall sections from the top to the bottom of the burner shell.

The nozzles associated to a distribution chamber thus in any case represent a stacked (superposed) array, wherein the outlets of the nozzles may be lined up exactly vertically or mutually offset (inclined) at an angle of up to 60°, preferably up to 50° from said vertical, in particular e.g. between about 0° to about 45°. In case of an off-vertical array of nozzles (nozzle outlets aligned at an angle to the vertical), the associated distribution chamber may be oriented similarly or be vertical, in which latter case the nozzle conducts are adapted to have the nozzle outlets at the chosen mutually offset locations. Other non-aligned variants of stacked nozzles, such as a zigzag set-up, are also possible. The advantage of having inclined or vertical distribution chambers according to the disclosure ensures a maximum stability to the burner shell. Furthermore, as the distribution chambers are inclined or vertical and generally over the whole height of the nozzle array, the nozzle conducts from the distribution chamber to the nozzle outlet may be executed horizontally, which again simplifies the design and the assembly of the burner shell. If desired, the nozzle conduct may of course be non-horizontal or even non-straight, especially if the vertical height of the inclined or vertical distribution chambers is less than the vertical height of the associated stacked array of nozzles. The cross-section of the nozzles and/or the nozzle conducts may be of any appropriate shape. The number of nozzles can be selected as appropriate depending on the size and the intended capacity of the burner. In general the number of nozzles per stacked array will be between 2 and 20, most often between 3 and 10, although the number may be above 20 if necessary or desired.

In particularly preferred embodiments, the burner assembly or hot blast stove further comprises a frustoconical secondary combustion chamber surrounded by a cone shell arranged below the burner, i.e. in the hot blast stove between the burner and the volume of checker bricks. In fact, this secondary combustion chamber has the shape of a frustum of a right circular cone oriented with its apex side on top and preferably having a cone aperture angle of between 50° and 70° (i.e. the angle measured between diametrically opposed sides of the cone.

The burning of the combustion media will normally take place within the burner (also called combustion chamber or primary combustion chamber). Due to the configuration of the cylindrical burner and especially the nozzle arrays according to the disclosure, the burning of the media is achieved in the layered swirl flow of the combustion media. By the provision of a frustoconical secondary combustion chamber, the swirl flow of the now normally burned off media continues its revolving along the inner side of the cone shell thus widening its diameter which in turn creates a vertical (axial) partial backflow to the burner (primary combustion chamber). This backflow of hot flue gases promotes an intensive mixing of the combustion media within the burner while allowing keeping the temperature in the burner at values above the kindling point even if and especially when the incoming combustion media are too cold.

The dimensions of the burner (primary combustion chamber) and the secondary combustion chamber (frustoconical section) are thus preferably chosen so that the backflow zone can stably form over the required load ranges. In general the height of the frustoconical section will be chosen to be 0.3 to 5 times, preferably 0.5 to 2 times the height of the primary combustion chamber.

The burner shell and cone shell may be made in one piece or preferably the burner shell is detachably affixed to the stove shell or the cone shell of the frustoconical secondary combustion chamber by flanges or similar means. By attaching the burner by a flange assembly or similar has the particular advantages, that the burner may be taken to the ground for repair and service or simply replaced by a burner of the same specification, or still more advantageously by a burner with different specifications (e.g. of higher capacity/more nozzles, etc.). Such a replacement or upgrade is moreover fast, thereby reducing downtime of the stove or even the plant.

In practice, burner assemblies as described herein will generally comprise two or more air distribution chambers and two or more gas distribution chambers. Hence, such burner assemblies preferably further comprise a manifold type air feeding pipes and gas feeding pipes integrated within or arranged outside the burner shell and fluidly connecting the air and gas distribution chambers to air and gas supply, respectively. In those configurations wherein two neighboring distribution chambers convey the same medium, such as in the two-by-two arrangement air-air-gas-gas . . . mentioned above, the two respective chambers may be connected by an integrated feeding pipe.

Preferably, there is provided a circulation zone (typically a cylindrical space or headroom) above the checker bricks for enhancing distribution of the flue gases over the entire cross-section of stove shell. This circulation zone is thus located below the burner assembly as described herein.

The hot blast stove may be a shaftless hot blast stove, i.e. wherein the main volume of checker bricks occupies essentially the whole cross-section of the stove and wherein the hot blast downpipe is arranged outside the stove shell. The hot blast stove may also be a hot blast stove having an inner shaft or hot blast downpipe.

In a third aspect, the disclosure also concerns the use of a burner assembly as described herein to refurbish, renovate or upgrade an existing hot blast stove of any type, be it top combustion or burner shaft type hot blast stoves. The disclosure also concerns a method of refurbishing, renovating or upgrading an existing hot blast stove comprising the steps of removing an existing burner assembly from said hot blast stove and mounting a burner assembly as described herein to said hot blast stove, preferably by means of a flange assembly.

BRIEF DESCRIPTION OF THE DRAWINGS

A preferred embodiment of the disclosure will now be described, by way of example, with reference to the accompanying drawings in which.

Further details and advantages of the present disclosure will be apparent from the following detailed description of several not limiting embodiments with reference to the attached drawings.

DESCRIPTION OF PREFERRED EMBODIMENTS

Figure 1:
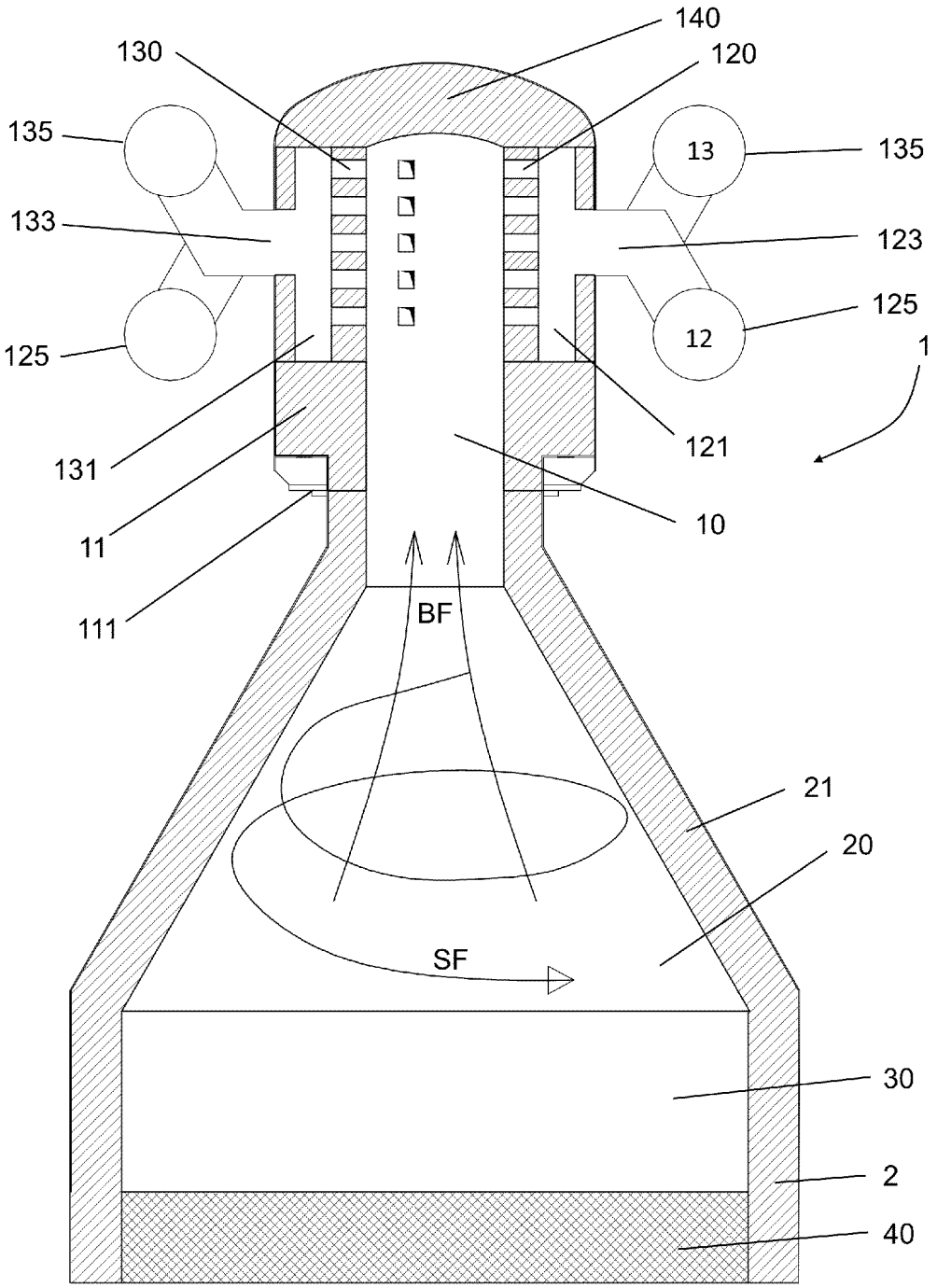
FIG. 1 is a cross sectional view of an upper part of a hot blast stove equipped with a preferred embodiment of a burner assembly according to the disclosure.

FIG. 1 shows a cross-section of the upper part of a preferred embodiment of an apparatus for heating air for the operation of regenerators (hot blast stoves) for blast furnaces.

The burner 10 has a burner shell 11 of circular cross-section and is axially mounted by flange assembly 111 in the upper section of the hot blast stove 1 which comprises a stove shell 2 with a main volume of regenerative checker bricks 40 for storing and exchanging heat and a circulation zone or headroom 30 without checker bricks.

Figure 2:
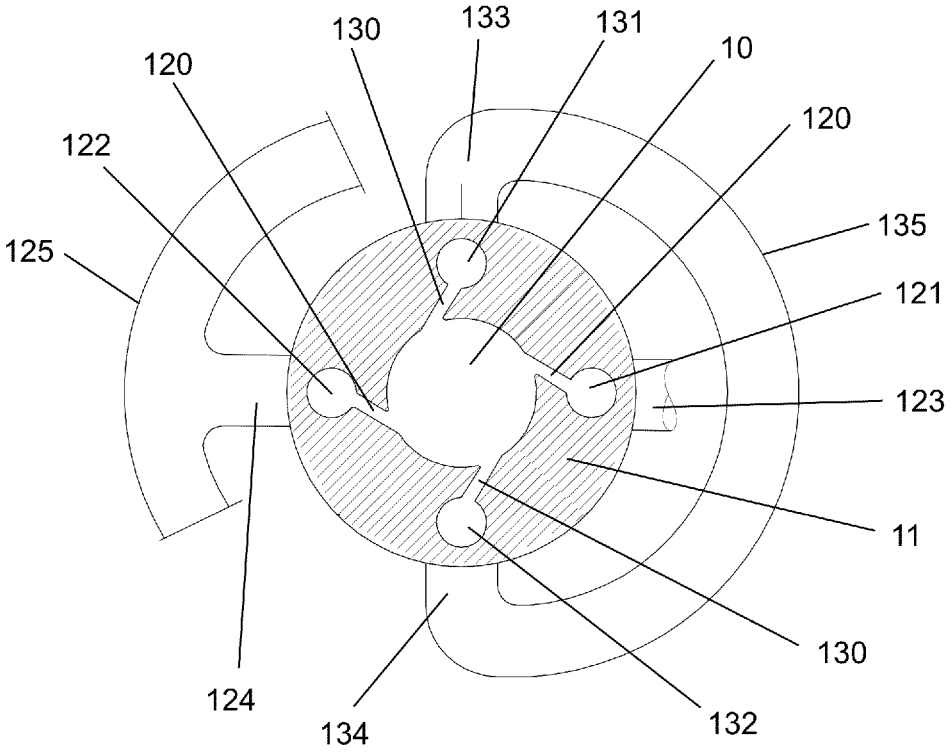
FIG. 2 is a partial cross sectional top view of a preferred embodiment of a burner assembly according to the disclosure.

The burner (or combustion chamber) 10 is closed on top by dome 140 and has separate feeding arrangements for the combustion media air 12 and gas 13. The feeding arrangements include air and gas feeding pipes 125, 135 and air and gas connecting pipes 123, 124, 133, 134 connecting the feeding pipes to the vertical air and gas distribution chambers 121, 122, 131, 132, respectively. Air and gas are fed to the burner 10 through a number of alternating vertical arrays of air nozzles 120 and gas nozzles 130. The number of vertical nozzle arrays can be two or more (four arrays are shown in FIGS. 1 and 2) and mainly depends on the size (diameter) of the burner. The number of nozzles within one array generally is between 2 and 10 or more (five nozzles are shown in each array in FIG. 1)

As can be seen in particular in FIG. 2, the vertical air and gas distribution chambers 121, 122, 131, 132 not only allow to feed arrays having a high number of stacked nozzles (and thus a burner with a significant height), but more importantly they leave enough room for the supporting wall structure of the burner shell 11. There is no fluidic horizontal connection between distribution chambers within the burner shell, which would weaken the burner shell structure, each vertical distribution chamber being separate from the adjacent distribution chambers even if two adjacent distribution chambers convey the same combustion medium. Indeed prior solution are based on ring distribution of the combustion media, which not only require a huge number of differently shaped bricks to be assembled as a burner shell, but also result in poor overall constructional stability.

Alternatively, the air and gas distribution chambers 121, 122, 131, 132 could also be inclined relative to the vertical axis of the burner, each distribution chamber thereby forming a section of a helix. The cross-section shown in FIG. 2 could also be a section through such an inclined distribution chamber configuration with alternating gas-air chambers. In FIG. 1, an inclined configuration would generally (but not necessarily) have the nozzles 120, 130 stacked at the same inclination angle than that of the distribution chambers.

The nozzles 120, 130 are arranged so that a substantially tangential inlet of the combustion media takes place in the burner 10. This tangential inlet in the burner can be effected by orientating the entire nozzle at an angle within burner shell 11 (such as shown in FIG. 2) or by providing only the outlet part of the nozzle with an appropriate design. The distribution of the alternating air and gas nozzle arrays on the circumference and the number of nozzles 120, 130 in each array over the height of the burner are adjustable to the size of the plant. More importantly, the alternation of tangential gas and air injection in the burner creates a swirl flow of alternating layers of combustion media which is advantageous for the mixing and combustion within the combustion chamber of the burner.

The burner geometry and the nozzle arrangement of the present disclosure are thus designed so that a high velocity swirl flow is produced within the combustion chamber in both axial and tangential directions.

In a particularly preferred embodiment, this burner 10 is combined with a conical (in fact frustoconical) secondary burner 20 which serves as an extended combustion chamber to burner 10 as well as a distribution device for the generated flue gases over the checker bricks 40. In fact, due to the frustoconical shape of the secondary combustion chamber the swirl flow generated within burner 10 widens as it flows down along the cone shell 21 thereby generating an axial inner (partial) backflow towards the burner 10. The intensive backflow of hot flue gases from the conical secondary combustion chamber 20 to burner 10 has not only the effect of further mixing the combustion media, but it also heats up the incoming combustion media, thereby increasing their ignition potential.

Although the combustion media are generally burned off before leaving the burner 10, the swirl flow within the secondary combustion chamber 20 contributes to complete the burn off if necessary, especially during start up of the combustion stage.

The invention claimed is:

1. A burner assembly for top combustion hot blast stove comprising:

a burner surrounded by a burner shell, wherein said burner has a circular cross-section;

a number of air nozzles arranged for tangentially feeding air to the burner, the air nozzles being connected to one or more air distribution chambers;

a number of gas nozzles arranged for tangentially feeding gas to the burner, the gas nozzles being connected to one or more gas distribution chambers;

wherein the air nozzles are arranged in one or more inclined or vertical stacked arrays of air nozzles, each inclined or vertical stacked array being in connection with one inclined or vertical air distribution chamber;

wherein the gas nozzles are arranged in one or more inclined or vertical stacked arrays of gas nozzles, each inclined or vertical stacked array being in connection with one inclined or vertical gas distribution chamber;

wherein the inclined or vertical air distribution chamber (s) and the inclined or vertical gas distribution chamber (s) are distributed along a circumference of the burner shell; and wherein the burner shell includes a plurality of continuous inclined or vertical wall sections disposed in between adjacent chambers from an outer surface of the burner shell to an inner surface of the burner shell.

2. The burner assembly as claimed in claim 1, wherein the inclined or vertical air and gas distribution chambers are arranged within the burner shell.

3. The burner assembly as claimed in claim 1, wherein a number of nozzles in each of the inclined or vertical stacked arrays of air and gas nozzles is between 2 and 20.

4. The burner assembly as claimed in claim 1, wherein the inclined stacked air and gas arrays are inclined at an angle up to 60° relative to a vertical axis of the burner.

5. The burner assembly as claimed in claim 1, further comprising a frustoconical secondary combustion chamber surrounded by a cone shell and arranged below the burner.

6. The burner assembly as claimed in claim 5, wherein the burner is detachably affixed to the cone shell of the frustoconical secondary combustion chamber by a flange.

7. The burner assembly as claimed in claim 5, wherein an aperture angle of the frustoconical secondary combustion chamber is between 50° and 70°.

8. The burner assembly as claimed in claim 5, wherein a height of a section of the frustoconical secondary combustion chamber section will be chosen to be 0.3 to 5 times the height of a primary combustion chamber.

9. The burner assembly as claimed in claim 1, comprising two or more air distribution chambers and two or more gas distribution chambers, further comprising a manifold type air feeding pipes and gas feeding pipes arranged outside the burner shell and fluidly connecting the air and gas distribution chambers to air and gas supply, respectively.

10. The burner assembly as claimed in claim 1, configured to refurbish, renovate, or upgrade an existing hot blast stove.

11. A top combustion hot blast stove comprising a stove shell; a volume of checker bricks arranged within said stove shell; and a burner assembly as claimed in claim 1, wherein said burner is axially arranged in an upper section of the stove shell.

12. The hot blast stove as claimed in claim 11, further comprising a circulation zone above the volume of checker bricks.

13. The hot blast stove as claimed in claim 11, further comprising a hot blast downpipe within the stove shell.

14. A method for refurbishing, renovating or upgrading an existing hot blast stove with an existing burner assembly, the method comprising the steps of removing the existing burner assembly from said hot blast stove and mounting a burner assembly as claimed in claim 1 to said hot blast stove.

* * * * *